US005772394A

United States Patent [19]

Yokota et al.

[11] Patent Number: 5,772,394

[45] Date of Patent: Jun. 30, 1998

[54] SELF-PRIMING CENTRIFUGAL PUMP

[75] Inventors: Hiroshi Yokota, 11-11-302, Midori 1-Chome, Minami-ku, Hiroshima-shi, Hiroshima-ken; Shingo Yokota, 17-27, Midori 3-Chome, Minami-ku, Hiroshima-shi, Hiroshima-ken, both of Japan

[73] Assignees: Kabushiki Kaisha Yokota Seisakusho, Hiroshima-ken; Hiroshi Yokota; Shingo Yokota, both of Hiroshima-hen, all of Japan

[21] Appl. No.: 632,408

[22] PCT Filed: Oct. 28, 1994

[86] PCT No.: PCT/JP94/01824

§ 371 Date: Feb. 5, 1997

§ 102(e) Date: Feb. 5, 1997

[87] PCT Pub. No.: WO95/12760

PCT Pub. Date: May 11, 1995

[30] Foreign Application Priority Data

Nov. 1, 1993 [JP] Japan ..... 5-273361

[51] Int. Cl.[6] ..... F04D 29/66

[52] U.S. Cl. ..... 415/56.1

[58] Field of Search ..... 415/56.1–56.6, 415/58.1, 58.4

[56] References Cited

U.S. PATENT DOCUMENTS

| | | | |
|---|---|---|---|
| 2,755,743 | 7/1956 | Rupp | 415/56.1 |
| 2,956,505 | 10/1960 | Jekat et al. | 415/56.1 |
| 3,125,030 | 3/1964 | Yokota et al. . | |

FOREIGN PATENT DOCUMENTS

| | | | |
|---|---|---|---|
| 569620 | 11/1957 | Italy | 416/56.1 |
| 28-1329 | 3/1928 | Japan . | |
| 28-3039 | 6/1928 | Japan . | |
| 38-15529 | 7/1938 | Japan . | |
| 50-21682 | 7/1995 | Japan . | |
| 44413 | 11/1938 | Netherlands | 416/56.1 |

*Primary Examiner*—John T. Kwon
*Attorney, Agent, or Firm*—Ladas & Parry

[57] ABSTRACT

The present invention is intended to provide a self-priming centrifugal pump with an excellent self-priming and pumping performance without destroying the nearly complete morphology of the volute type centrifugal pump. The principle of self-priming action that circulates self-priming water by the characteristics of a larger volute and a smaller volute formed around the periphery of an impeller to drive out an air-water mixture produced by vortices generated by the impeller is elucidated in the description of "Double Volute Centrifugal Pump" proposed in JP-B No. 28-3039. Efforts have been concentrated on locally supporting the bottom of a tornado-like cavity formed by a whirling current of self-priming water for centrifugally separating air from self-priming water and secondary technical problems accompanying such efforts could not have been solved. The present invention forms a spiral guide passage (F) in an upper part of a self-priming water separating chamber (e) to lower the rising head of a whirling current of self-priming water, forms a curved passage (d) on the bottom (E) of the self-priming water separating chamber (e) so as to direct most part of self-priming water in the outer portion of the whirling current into a larger volute (v2) or forms a spiral guide passage (G) on the lower cylindrical surface of the self-priming water separating chamber (e) so as to direct most part of self-priming water in the outer portion of the whirling current into the larger volute (v2) to solve technical problems in the prior art and to provide a self-priming centrifugal pump capable of supplying water in a straight current to the following process.

3 Claims, 2 Drawing Sheets

( X-X SECTION )

( Y-Y SECTION )

SELF-PRIMING CENTRIFUGAL PUMP

TECHNICAL FIELD

The present invention is intended to provide a self-priming centrifugal pump to be applied to automatic operative systems capable of serving for highly reliable automatic pumping and automatic water conveying in various industrial fields, having a simple construction, capable of economical operation and having high self-priming ability.

In the specification, the statement of claims and the abstract herein, "water" is a generic term for a liquid, and "air" is a generic term for a gas.

BACKGROUND ART

A conventional centrifugal pump for pumping up water is provided with a device, such as a vacuum pump, necessary only for priming. Likewise, various self-priming pumps invented to overcome disadvantages in conventional pumps of such a type are provided unavoidably with a device necessary only for priming, such as a self-priming water tank or an air separator tank.

The present invention relates to improvements in a double volute centrifugal pump disclosed in JP-B No. 28-3039 (hereinafter referred to as "first prior invention"), a self-priming centrifugal pump based on an improved self-priming principle, disclosed in JP-B No. 38-15529 (hereinafter referred to as "second prior invention"), and a self-priming double volute centrifugal pump disclosed in JP-B No. 50-21682 (hereinafter referred to as "third prior invention"). The first, the second and the third prior invention will be inclusively called prior inventions.

The centrifugal pump unit of each of those prior inventions is characterized by a common passage that serves as both a priming water circulating passage and a discharge passage during normal pumping operation, which is a distinctive feature of the pump unit of the prior invention which is not found in previously known various self-priming centrifugal pumps. However, the development of new technical ideas is necessary to obtain a pump with further improved pumping and self-priming performance.

For example, the second prior invention obtained by incorporating improvements into the first prior invention overcomes satisfactorily technical difficulties in the conventional pumps, has a simple construction, can be easily fabricated, has an expected ability and is used for various purposes. However, the second prior invention is not perfectly satisfactory because an elastic material cannot be used for forming a separating disk disposed on the bottom of the air separator chamber when the second prior invention is intended to be used for pumping a liquid of a specific quality.

If priority is given only to self-priming performance, the separating disk disposed on the bottom of the air separator chamber need not be made of an elastic material like that used for forming the separating disk of the second prior invention, and it is necessary only to form an annular passage in a sufficiently narrow width to prevent the air from- being sucked into the larger volute by supporting the bottom of a tornado-like cavity formed in the whirling currents of priming liquid. The third prior invention is provided with a "cavity support" for such a purpose. The cavity support, however, entails serious problems that the pumping performance of the centrifugal pump is deteriorated, and the centrifugal pump is blocked with earth, sand and dust etc. during pumping operation.

Although new technical improvements are found in the prior inventions, the prior inventions still have difficult problems in selecting an elastic material capable of properly serving in pumping a liquid of a specific quality or in designing the construction, and the prior inventions are hardly possible to serve as means for radically solving problems in the prior art.

Furthermore, either the second prior invention or the third prior invention is not satisfactory as a pumping apparatus or a water conveying apparatus, because a jet stream flowing from the smaller volute readily twists a current discharged from the air separator chamber serving as a diffuser for the larger volute, and tends to generate turbulent currents in the discharge pipe.

The present invention is intended to solve those technical problems in the prior art, and to provide an excellent self-priming centrifugal pump free from restrictions attributable to the quality of a liquid to be pumped and from being blocked, and capable of exerting high self-priming performance and high pumping-up performance when applied to an automatic operative system and of sending an advantageous straight current to the following process.

DISCLOSURE OF THE INVENTION

The present invention provides a self-priming centrifugal pump with an excellent self-priming performance and a pumping performance without destroying the nearly complete morphology of the volute type centrifugal pump.

The construction of the present invention will be described in- connection of preferred embodiments of the invention with reference to the accompanying drawings. Shown in FIG. 1 are a pump casing 1, an impeller 4, impeller blades 5, a main shaft 6, a discharge pipe 7, an inlet passage a and a vortex chamber b. A smaller volute v1 opening up and a larger volute v2 opening down are formed at diametrically opposite positions, respectively, in the pump casing 1. The smaller volute v1 extends from a position at a lower level below that of the suction opening of the impeller 4, and the larger volute v2 extends from a position at a level above that of the suction opening of the impeller 4. A space s1 between the circumference of the impeller 4 and the smaller volute v1 at the position from which the smaller volute v1 extends is greater than a space s2 between the circumference of the impeller 4 and the larger volute v2 at the position from which the larger volute v2 extends. The passage area of the discharge passage of the larger volute v2 increases gradually and forms a self-priming water separating chamber e of an upright cylindrical shape extending along the smaller volute v1.

A spouting passage c for water flow from the smaller volute v1 extends in a curve and merges substantially tangentially into the surface of the cylindrical wall of the separating chamber e to guide self-priming water so that self-priming water flowing from the smaller volute v1 may flow in a whirling current. A guide passage F is formed between an upper part of the separating chamber e and at an upper level than the spouting passage c so as to lower the rising head of the whirling current of self-priming water. A curved guide passage d is formed on the bottom E of the separating chamber e so as to guide and force most of self-priming water in the outer periphery of the whirling current of the self-priming water toward the large volute v2, rather than a tornado-like cavity formed in the whirling current.

BEST MODE FOR CARRYING OUT THE INVENTION

Figure 1:
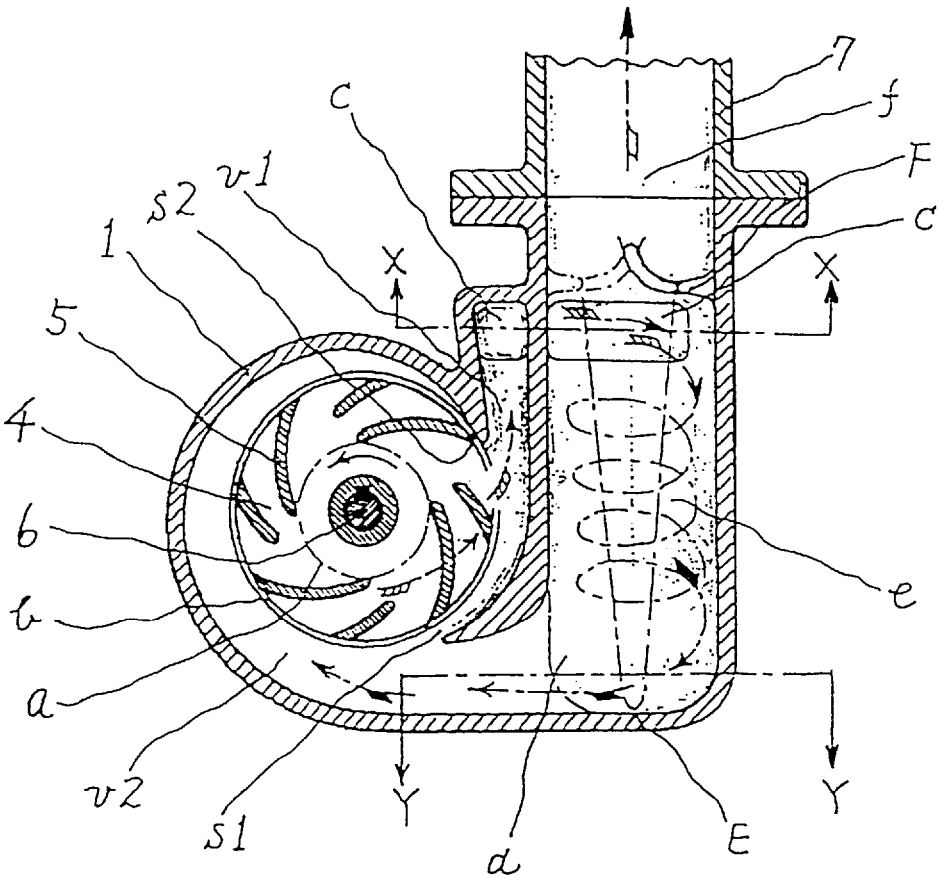
FIG. 1 is a cross-sectional view of a self-priming centrifugal pump according to a preferred embodiment of the present invention.
Figure 2:
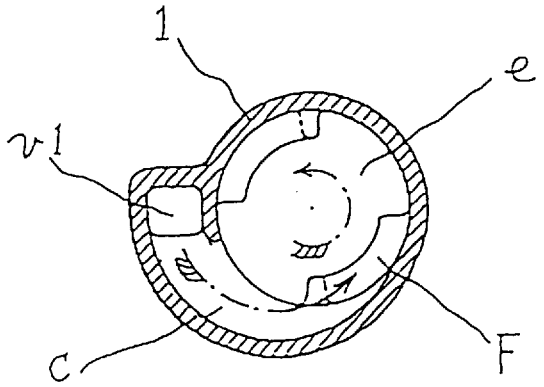
FIG. 2 is a fragmentary sectional view taken along line X—X in FIG. 1.
Figure 3:
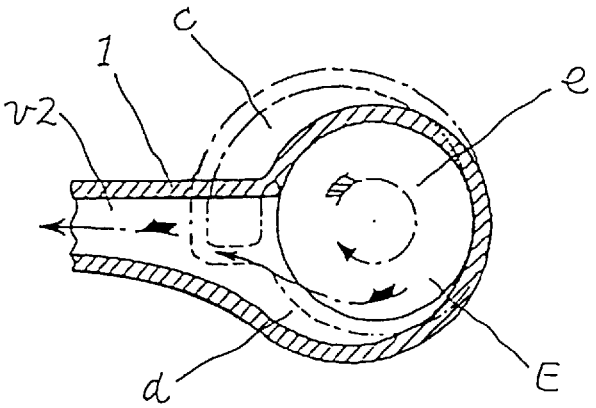
FIG. 3 is a fragmentary sectional view taken along line Y—Y in FIG. 1.

Function of the self-priming centrifugal pump of the present invention will be described with reference to FIGS. 1 through 3 showing an embodiment of the invention. First, a necessary amount of water is supplied into the self-priming centrifugal pump and the impeller 4 is rotated. Consequently, the water is accelerated by the impeller 4 and flows mostly into the smaller volute v1. The water is spouted through the spouting passage c into a self-priming water separating chamber e. Thus, the water supplied into the pump circulates through a circulating passage 4→v1→c→e→d→v2→4. As the water circulates through the circulating passage, a vortex is generated inside the impeller 4, and the vortex draws in air prevailing around the central portion of the impeller 4 to change it into water containing bubbles, i.e., an air-water mixture, which is spouted into the separating chamber e.

Self-priming water (air-water mixture) spouted into the separating chamber e flows in a whirling current along the surface of the wall of the separating chamber e by its own energy. Owing to a centrifugal separating effect, the bubbles form instantly a tornado-like cavity having a shape of an inverted circular cone in the central region of the separating chamber e and the air thus separated from the self-priming water flows toward and is discharged upward through the discharge passage f.

In the present invention, the spiral guide passage F formed in the upper portion of the separating chamber e ensures suppression of rise of the head of the whirling current of the self-priming water, and the curved guide passage d formed on the bottom E of the separating chamber e guides most part of the whirling current of the self-priming water separated from the air bubbles into the larger volute v2. The curved passage d holds the bottom of the tornado-like cavity in a region near the central portion thereof to prevent the air separated from the self-priming water from flowing into the larger volute v2 and allows only the self-priming water to circulate smoothly.

The centrifuged air flows gradually upward and is discharged to the outside of the self-priming centrifugal pump, and thus the self-priming action is completed before long. After the normal pumping condition has been established, the smaller volute v1, the larger volute v2 and the separating chamber e form a normal passage a→4 →v2→d→e→f and a→4→v1→c→e→f of the centrifugal pump for satisfactory pumping. During the normal pumping operation, resistance to flow is small, clogging does not occur and a high pumping-up performance is obtained because the separating chamber e functioning as a principal water pumping-up passage does not include therein any flow restricting means such as a "cavity support". Further, water that is revolvingly guided by the passage d extending between the larger volute v2 and the bottom E of the separating chamber e joins the whirling current of the water spouted through the spouting passage c of the smaller volute v1, and flows in a rotational direction to suppress the whirling current. The flow of the water is further straightened by the effect of the guide passage F, and the water flows in a substantially straight current into the discharge passage f, so that an adverse effect of the whirling current does not influence the following process connected to the centrifugal pump.

Figure 4:
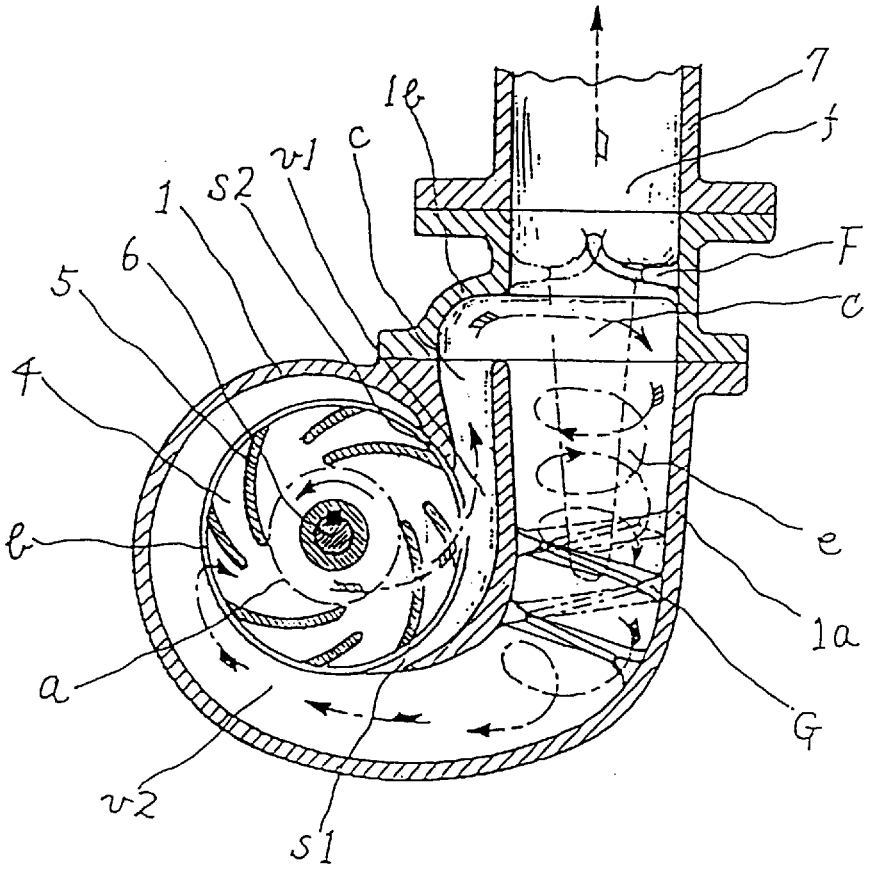
FIG. 4 is a cross-sectional view of a self-priming centrifugal pump according to another embodiment of the present invention.

FIG. 4 shows another preferred embodiment of the present invention. A self-priming centrifugal pump shown has a guide passage G formed on the cylindrical wall of the self-priming water separating chamber e in an area lower than the spouting passage c to direct most part of the self-priming water in the outer portion of a whirling current into a larger volute v2 and to prevent the bottom part of a tornado-like cavity from extending into the larger volute v2, as in the case of the guide passage d. A pump casing is divided into an impeller casing la and a discharge casing 1b to facilitate forming the pump casing by casting, finishing and cleaning the passages.

In the foregoing embodiments, the guide passages may be of either a guide vane type or a guide groove type. When casting the pump casing provided with a guide passage of either a guide vane type or a guide groove type by using a core, the mold can be removed without obstruction and the pump casing is convenient for manufacture.

When practicing the prior inventions, the discharge pipe was extended to a necessary level or the self-priming water separating chamber e was formed to have an inner diameter far greater than that of the discharge pipe to prevent the overflow of the rising whirling current of self-priming water from the discharge pipe, or a restricting means was formed at the discharge opening of the pump to avoid a redundant shape. However, the loss due to the resistance of the restricting means to the water flow was unignorable in the use of the pump. Thus, the prior inventions unavoidably had both advantages and disadvantages. The self-priming centrifugal pump according to the present invention prevents the blow-up of the whirling current of priming water, reduces the loss due to the resistance of the passages to the water flow and discharges water in a straight current to overcome every technical difficulty in the prior art. Naturally, the aforesaid prior art techniques may be properly incorporated into the self-priming centrifugal pump for enhancement of the pumping performance.

It goes without saying that the guide passages d and G may be used in combination for the further enhancement of self-priming and pumping performances.

Naturally, the present invention may employ the prior art technical means; for example, when each of the embodiment shown in FIGS. 1 to 3 and the embodiment shown in FIG. 4 is used for suction pumping operation, a portion of a suction pipe connected to the pump is raised in a curved section so that the lower end of the cross section of the highest portion of the curved section is on a level above the necessary level of the surface of priming water for self-priming, and a check valve is provided on the suction pipe to prevent the priming water from overflowing through the suction opening when the pump is stopped.

Various changes may be made in the embodiments specifically described herein within the gist of the invention, and the present invention is not limited in its practical application to the embodiments thereof specifically described herein.

INDUSTRIAL APPLICABILITY

As is apparent from the foregoing description, the present invention provides a self-priming centrifugal pump with an excellent self-priming and pumping performance without destroying the nearly complete morphology of the volute type centrifugal pump. The self-priming centrifugal pump of the present invention is believed to be an ideal self-priming centrifugal pump solving technical difficulties which could not have been solved by the practical application of self-priming theories of the prior art for the following reasons.

1. The morphology of the self-priming centrifugal pump of the present invention is similar to that of the nearly complete volute type centrifugal pump and provides high pumping performance.

2. The self-priming centrifugal pump of the present invention has a high self-priming ability and is applicable to automatic suction pumping operation without any problem.

3. The self-priming centrifugal pump of the present invention is not subject to any restrictions attributable to the quality of the liquid to be pumped and is not hardly blocked up.

4. The self-priming centrifugal pump of the present invention operates silently and is able to send the liquid in an advantageous straight current to the following process.

5. The self-priming centrifugal pump of the present invention is simple in construction, can be easily manufactured and is economical.

We claim:

1. A self-priming centrifugal pump comprising: an impeller (4); and a pump casing (1) having a smaller volute (v1) and a larger volute (v2); a space (s1) being formed between the outer circumference of the impeller (4) and a starting end of the smaller volute (v1), said space being greater than a space (s2) between the outer circumference of the impeller (4) and a starting end of the larger volute (v2); a circulating current of self-priming water flowing from the smaller volute (v1) to the larger volute (v2); a diffusing part of the larger volute (v2) being formed so as to guide a current of the self-priming water spouted through a spouting passage (c) of the smaller volute (v1) so that the current of the self-priming water flows tangentially to an upright, cylindrical self-priming water separating chamber (e) to generate a whirling current of the self-priming water:

characterized in that guide passage means (F) for lowering the rising head of the whirling current of the self-priming water is provided on a cylindrical wall of the self-priming water separating chamber (e) in an upper area of said cylindrical wall toward a discharge side than said spouting passage (c).

2. A self-priming centrifugal pump comprising: an impeller (4); and a pump casing (1) having a smaller volute (v1) and a larger volute (v2); a space (s1) being formed between the outer circumference of the impeller (4) and a starting end of the smaller volute (v1), said space being greater than a space (s2) between the outer circumference of the Impeller (4) and a starting end of the larger volute (v2); a circulating current of self-priming water flowing from the smaller volute (v1) to the larger volute (v2); a diffusing part of the larger volute (v2) being formed so as to guide a current of the self-priming water spouted through a spouting passage (c) of the smaller volute (v1) so that the current of the self-priming water flows tangentially to an upright, cylindrical self-priming water separating chamber (e) to generate a whirling current of the self-priming water:

characterized in that guide passage means (d) for directing most part of said whirling current in an outer portion thereof into the larger volute (v2) is provided on a bottom (E) of the self-priming water separating chamber (e).

3. A self-priming centrifugal pump comprising: an impeller (4); and a pump casing (1) having a smaller volute (v1) and a larger volute (v2); a space (s1) being formed between the outer circumference of the impeller (4) and a starting end of the smaller volute (v1), said space being greater than a space (s2) between the outer circumference of the impeller (4) and a starting end of the larger volute (v2); a circulating current of self-priming water flowing from the smaller volute (v1) to the larger volute (v2); a diffusing part of the larger volute (v2) being formed so as to guide a current of the self-priming water spouted through a spouting passage (c) of the smaller volute (v1) so that the current of the self-priming water flows tangentially to an upright, cylindrical self-priming water separating chamber (e) to generate a whirling current of the self-priming water:

characterized in that guide passage means (G) for directing most part of said whirling current in an outer portion thereof into the larger volute (v2) is provided on a part of said cylindrical wall of the self-priming water separating chamber (e) in an area, below said spouting passage (c) of the self-priming water separating chamber (e).

* * * * *